United States Patent [19]

Fringeli et al.

[11] 4,386,965

[45] Jun. 7, 1983

[54] PROCESS FOR OBTAINING COATING COMPOSITIONS OF IMPROVED WHITENESS

[75] Inventors: Werner Fringeli, Laufen; Max Flubacher, Basel, both of Switzerland; Alain Lauton, St. Louis, France

[73] Assignee: Ciba-Geigy Corporation, Ardsley, N.Y.

[21] Appl. No.: 223,174

[22] Filed: Jan. 7, 1981

[30] Foreign Application Priority Data

Jul. 3, 1980 [CH] Switzerland ..... 5140/80

[51] Int. Cl.[3] ..... C09D 3/20; C09K 11/06; D06P 3/852

[52] U.S. Cl. ..... 106/214; 106/209; 106/137; 106/148; 8/584; 8/648; 252/301.23; 524/100

[58] Field of Search ..... 8/584, 648; 252/301.23; 106/214

[56] References Cited

U.S. PATENT DOCUMENTS

| | | | |
|---|---|---|---|
| 2,956,898 | 10/1960 | Fleck | 8/648 |
| 3,600,385 | 8/1971 | Loffelman et al. | 8/648 |
| 3,672,816 | 6/1972 | Dehnert | 8/648 |
| 3,900,608 | 9/1975 | Dierkes et al. | 8/648 |
| 4,258,448 | 3/1981 | Reitz et al. | 8/584 |

FOREIGN PATENT DOCUMENTS

| | | | |
|---|---|---|---|
| 813769 | 5/1969 | Canada | 8/648 |
| 2806194 | 8/1977 | Fed. Rep. of Germany . | |
| 43-27144 | 11/1968 | Japan | 8/584 |
| 49-30866 | 8/1974 | Japan | 8/584 |
| 1294173 | 10/1972 | United Kingdom . | |
| 1391593 | 4/1975 | United Kingdom . | |

*Primary Examiner*—Maria Parrish Tungol
*Attorney, Agent, or Firm*—Edward McC. Roberts

[57] ABSTRACT

A process is disclosed for obtaining coating compositions of improved whiteness for coating paper or cardboard using fluorescent whitening agents of the bis-triazinylaminostilbene-2,2'-disulfonic acid series, which process comprises adding to the coating compositions, in addition to the respective fluorescent whitening agent, an acid phosphoric acid ester of an oxyalkylated fatty amine of the formula

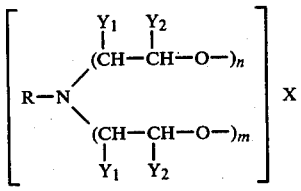

(1)

or an alkali metal salt, ammonium salt or amine salt thereof, wherein R is an aliphatic hydrocarbon radical of 8 to 22 carbon atoms, $Y_1$ and $Y_2$ are both hydrogen, or one of $Y_1$ and $Y_2$ is hydrogen and the other is methyl, X is the acid radical of phosphoric acid, the acid hydrogen atoms of which radical can be replaced by alkali metal ions, ammonium ions or amine salt ions, and m and n are integers, the sum of which is 2 to 30. To the coating compositions can also be added organic solubilizers, non-ionic or anionic surfactants and/or polar organic compounds. Coating compositions which contain the above fluorescent whitening agents and assistants are also disclosed.

16 Claims, No Drawings

PROCESS FOR OBTAINING COATING COMPOSITIONS OF IMPROVED WHITENESS

The present invention relates to a process for obtaining coating compositions of improved whiteness for coating paper or cardboard using fluorescent whitening agents of the bis-triazinylaminostilbene-2,2'-disulfonic acid series, to whitened coating compositions and to the paper or cardboard coated therewith.

It is known that fluorescent whitening agents of the class of bis-triazinylaminostilbene-2,2'-disulfonic acids are suitable for whitening paper. When whitening coating compositions, however, problems arise depending on the fluorescent whitening agent employed and on the composition of the coating composition, so that either the white effects obtained are unsatisfactory or many fluorescent whitening agents are quite unsuitable for application in certain coating compositions. When high concentrations of fluorescent whitening agent are used there often occurs a sharp decrease, instead of an increase, in the degree of whiteness, and the coating composition often also takes on a greenish hue. This undesirable effect occurs in particular when many of the above mentioned fluorescent whitening agents are added to coating compositions which contain synthetic binders.

Efforts have already been made to overcome these difficulties. For example, solubilisers, especially polyethylene glycol, have been added to the coating composition. When using many fluorescent whitening agents, this measure results in a certain increase in the white effect, but, when using others, it fails. Moreover, any increase in the white effect obtained is often unsatisfactory.

Other solutions proposed have been the addition of surfactants (cf. British patent specification No. 1 294 173), or of amide-formaldehyde resins (cf. German Offenlegungsschrift No. 2 229 872), to the coating compositions. Although white effects are obtained, they do not meet the desired requirements as regards the degree of whiteness. In any case, these measures are only applicable to coating compositions which contain synthetic binders, but not to technically important mixtures of natural and synthetic binders.

German Offenlegungsschrift Nos. 2 806 194 and 2 806 195 disclose coating compositions to which is added a disperse fluorescent whitening agent or a bis-triazinylaminostilbene-2,2'-disulfonic acid fluorescent whitening agent in admixture with water, an organic liquid which boils above 150° C., e.g. triethylphosphate, trioctylphosphate, tricresylphosphate or trichloroethylphosphate, and a solubiliser, e.g. a non-ionic emulsifier. This method is suitable primarily for disperse fluorescent whitening agents. Moreover, the use of relatively expensive high-boiling organic solvents is not advantageous for a variety of reasons.

Accordingly, it is the object of the present invention to provide a process that does not have the drawbacks referred to above, that results in better white effects especially when using bis-triazinylaminostilbene-2,2'-disulfonic acid fluorescent whitening agents in coating compositions, that eliminates the greenish hue occuring in coating compositions when using higher concentrations of fluorescent whitening agent, and that makes it possible to use many fluorescent whitening agents of the above class which up to now were not considered suitable for this application.

Surprisingly, it has been possible to attain this object by adding to the coating composition, besides the fluorescent whitening agent, an acid phosphoric acid ester of an oxyalkylated fatty amine of the formula (1) below. This measure results in a substantial improvement in the degree of whiteness of the whitened coating composition, especially when using higher concentrations of fluorescent whitening agent, and the undesirable greenish discolouration of the coating composition is avoided. In contrast to the conventional whitening of coating compositions with bis-triazinylaminostilbene-2,2'-disulfonic acid fluorescent whitening agents, the degree of whiteness increases almost linearly with the logarithm of the increasing concentration of fluorescent whitening agent, so that very high degrees of whiteness can be obtained.

Accordingly, the process for obtaining coating compositions of improved whiteness for coating paper or cardboard using fluorescent whitening agents of the bis-triazinylaminostilbene-2,2'-disulfonic acid series comprises adding to the coating compositions, in addition to the respective fluorescent whitening agent, an acid phosphoric acid ester of an oxyalkylated fatty amine of the formula

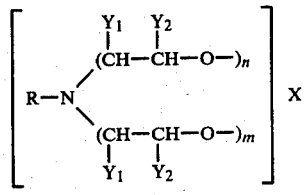

(1)

or an alkali metal salt, ammonium salt or amine salt thereof, wherein R is an aliphatic hydrocarbon radical of 8 to 22 carbon atoms, $Y_1$ and $Y_2$ are both hydrogen, or one of $Y_1$ and $Y_2$ is hydrogen and the other is methyl, X is the acid radical of phosphoric acid, the acid hydrogen atoms of which radical can be replaced by alkali metal ions, ammonium ions or amine salt ions, and m and n are integers, the sum of which is 2 to 30.

In the assistants of the formula (1) employed in the process of this invention, the aliphatic radical R is preferably an alkyl or alkenyl radical (branched or unbranched) of 10 to 18 carbon atoms. Preferred assistants have the formula

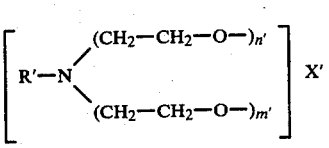

(2)

wherein R' is an alkyl or alkenyl radical of 10 to 18 carbon atoms, X' is the acid radical of phosphoric acid, the acid hydrogen atoms of which radical can also be replaced by alkali metal ions or ammonium ions, and n' and m' are integers, the sum of which is 4 to 20.

Especially preferred compounds of the formula (2) employed in the process of the invention are those in which the sum of n'+m' is 6 to 8, most preferably those in which R' is the lauryl radical, in which case the sum of n'+m' is most preferably 8.

The radical R generally does not have to contain a specific number of carbon atoms, but can also be a mixture of hydrocarbon chains of different length such as many fatty amines which are derived from natural fats have. A preferred radical of this kind is the hydrocarbon radical of tallow fatty amine. The preferred meaning of $Y_1$ and $Y_2$ in formula (1) is hydrogen.

The acid component of the ester of formula (1) is phosphoric acid. X is therefore the radical of phosphoric acid, whilst the terminal OH groups of the ethylene oxide or propylene oxide chains can be completely or only partially esterified. The number of acid hydrogen atoms in the phosphoric acid radical X is contingent on the degree of esterification, which need not be a whole number. These acid hydrogen atoms can also be replaced by alkali metal ions, ammonium ions or amine salt ions, so that the radical X is in salt form. However, it is preferred that the radical X is in its acid form.

Depending on the degree of esterification, possible structures of compounds of the formula (1) are for example ($Y_1$ and $Y_2$=H):

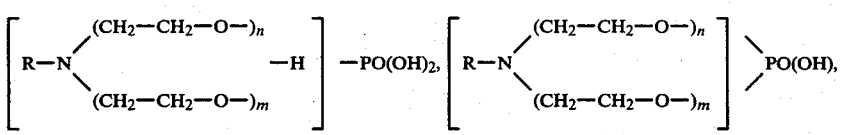

(1a)

(1b)

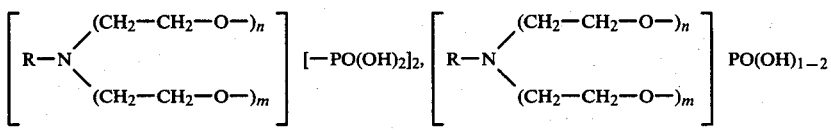

(1c) (1d)

and the like.

Bis-triazinylaminostilbene-2,2'-disulfonic acid fluorescent whitening agents which can be used for whitening coating compositions in the process of this invention are, in particular, those of the formula

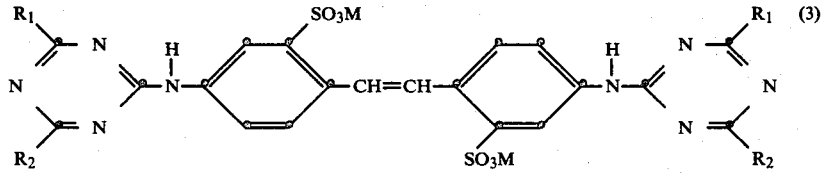

(3)

wherein M is hydrogen, or an alkali metal ion, ammonium ion or amine salt ion, and $R_1$ and $R_2$ are $NH_2$, $NH—CH_3$, $NH—C_2H_5$, $N(CH_3)_2$, $N(C_2H_5)_2$, $NH—CH_2—CH_2—OH$, $NH—CH_2—CH_2—CH_2—OH$, $N(CH_2—CH_2—OH)_2$, $N(CH_2—CH_2—CH_2—OH)_2$, $N(CH_3)(CH_2—CH_2—OH)$, $NH—CH_2—CH_2—O—CH_2—CH_2—OH$, $NH—CH_2—CH_2—SO_3M$, OH, $OCH_3$, $OCH(CH_3)_2$, $O—CH_2—CH_2—O—CH_3$,

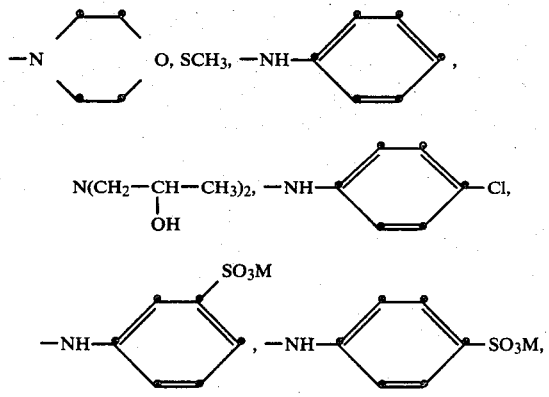

It is preferred to use a fluorescent whitening agent of the formula

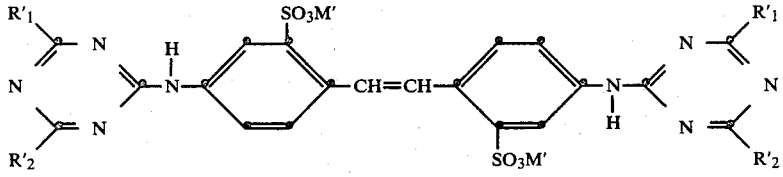

(4)

wherein $R_1'$ is $—NHCH_2CH_2OH$, $—N(CH_2CH_2OH)_2$, $—N(CH_2CH_3)_2$ or

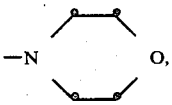

$R_2'$ is

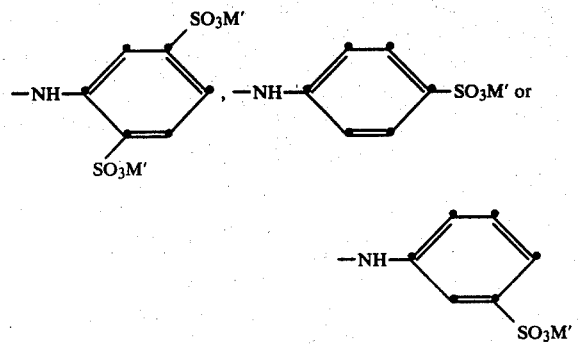

and M' is hydrogen or an alkali metal ion, an ammonium, diethanolammonium or triethanolammonium ion.

The sulfo groups —$SO_3M$ in compounds of the formula (3) can be in the free form (M=H) or in salt form. M is then an alkali metal ion, especially a sodium or potassium ion, an ammonium ion or an amine salt ion, e.g. of a primary or secondary alkylamine, the alkyl group or groups of which can be substituted by halogen, hydroxyl (e.g. ethanolamine, diethanolamine, triethanolamine) or alkoxy, or of a cyclic amine, e.g. a piperidine, pyrrolidine, piperazine or morpholine.

The acid hydrogen atoms in the phosphoric acid radical X of the compounds of the formula (1) or (2) can, if desired, be replaced by the same ions as defined above for M. The radical X is then in salt form.

In addition to fluorescent whitening agent and assistant of the formula (1), it can often be advantageous to add to the coating composition other substances which either have a booster action or which favourably influence the properties of the coating composition. Suitable additional assistants of this kind are non-ionic or anionic surfactants, organic solubilisers or certain polar organic compounds or mixtures thereof.

Examples of organic solubilisers and polar organic compounds which can be used are: lower monohydric alcohols, polyhydric alcohols, ether alcohols, not too high molecular weight polyglycols or carboxamies. Examples of such solvents are: propanol, isopropanol, ethylene glycol, propylene glycol, butylene glycol, glycerol, ethylene glycol monomethyl, monoethyl, monopropyl or monobutyl ether, dipropylene glycol, formamide, dimetyl formamide, dimethyl acetamide and N-methylpyrrolidone. Preferred solvents of this kind are ethylene glycol and N-methylpyrrolidone. Further suitable solubilisers and solvents are amines such as triethanolamines and other water-soluble polar compounds such as dimethyl sulfoxide, dimethyl methanephosphonate, dimethyl sulfone, sulfolane (tetrahydrothiophene-1,1-dioxide), ethylene carbonate or propylene carbonate, and also urea or substituted ureas, e.g. tetramethylurea.

Examples of non-ionic surfactants which can be used are: adducts of alkylene oxides, especially of ethylene oxide, with higher fatty acids, fatty acid amides, aliphatic alcohols, mercaptans or amines, with alkylphenols or alkylthiophenols containing at least 7 carbon atoms in the alkyl moieties, or with phenylphenols, e.g. polyglycol-(monoalkylphenyl) ethers containing at least 8 to 12 carbon atoms in the alkyl moiety and at least 8 unsubstituted or substituted glycol units, e.g. decaethylene glycol monooctoylphenyl ether or the reaction product of monononylphenol with 5 to 35 moles of ethylene oxide; copolymers of ethylene oxide and higher alkylene oxides, e.g. propylene oxide or butylene oxide; non-ionic esters of adducts of alkylene oxides, e.g. the tertiary phosphoric acid ester of the adduct of 40 moles of ethylene oxide and monononylphenol; esters of polyalcohols, especially monoglycerides of fatty acids containing 12 to 18 carbon atoms, e.g. the monoglycerides of lauric, stearic or oleic acid; N-acylated alkanolamines of the same type as mentioned for the sulfates of these compounds (see below), e.g. the N,N-bis-(ω-hydroxyalkyl)amides of the mixtures of acids collectively known as coconut oil fatty acids, in particular N,N-bis-(β-hydroxyethyl)amide or N,N-bis-(γ-hydroxypropyl)amide, and also the adducts of ethylene oxide with these N-acylated alkanolamines; reaction products of higher fatty acids with an alkanolamine, the molar ratio of alkanolamine to fatty acid being greater than 1, e.g. 2. Suitable fatty acids are, in particular, those containing 8 to 18 carbon atoms, as well as the mixtures known as coconut oil fatty acids. A suitable alkanolamine is, in particular, diethanolamine.

Examples of suitable anionic surfactants which can be used are: sulfated alkylene oxide adducts, especially sulfated ethylene oxide adducts, such as sulfated adducts of 1 to 40 moles of ethylene oxide with fatty acid amides, mercaptans or amines, but in particular with fatty acids, aliphatic alcohols or alkylphenols containing 8 to 20 carbon atoms in the alkyl chain, e.g. with stearic acid, oleic acid, lauryl alcohol, myristyl alcohol, stearyl alcohol, oleyl alcohol, octyl phenol or nonylphenol. Instead of the sulfates, it is also possible to use the esters of other polyvalent acids. Such esters comprise e.g. the primary and secondary esters of phosphoric acid as well as the hemiesters of sulfosuccinic acid; sulfates of N-acylated alkanolamines, e.g. the sulfated amides of caprylic acid, pelargonic acid, capric acid, lauric acid, myristic or stearic acid, or of lower fatty acids substituted by alkylphenoxy groups, e.g. octyl- or nonylphenoxyacetic acid, with mono- or bis-hydroxyalkylamines such as β-hydroxyethylamine, γ-hydroxypropylamine, β,γ-dihydroxypropylamine, bis-(β-hydroxyethyl)amine, or with N-alkyl-N-hydroxyalkylamines such as N-methyl- or N-ethyl-N-(β-hydroxyethyl)amine; and sulfated esterified polyoxy compounds, e.g. sulfated, partially esterified polyhydric alcohols, such as the sodium salt of the sulfated monoglyceride of palmitic acid.

The acid phosphoric acid esters of oxyalkylated fatty amines of the formula (1) employed in the process of this invention are known and can be easily obtained by esterification of an oxyalkylated fatty amine of the formula

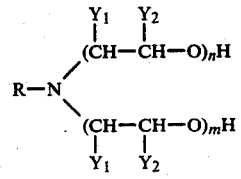

(5)

wherein the general symbols are as defined for formula (1), with phosphoric acid, phosphorus pentoxide or a halide of phosphoric acid. The reaction with phosphorus pentoxide is preferred. The esterification is conveniently carried out by a simple mixing of the reactants with simultaneous heating, e.g. to 50°–100° C. If desired, the acid esters can be converted into the corresponding salts (alkali metal, ammonium or amine salts), e.g. in conventional manner by addition of the appropriate base, e.g. ammonia, monoethanolamine, triethanolamine or an alkali metal hydroxide.

The compound of the formula

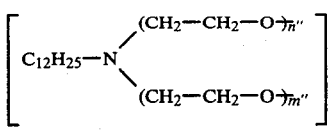

(6)

wherein the sum of n''+m'' is 8 and X is an acid phosphoric acid radical, can be obtained as follows: 914.6 g of the compound of the formula

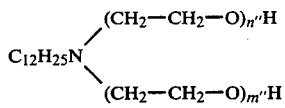

(7)

are put at room temerature into a flask and, with stirring, cooled to 18° C. with a water/ice bath. Then 80.94 g of phosphorus pentoxide are added rapidly. The cooling bath is removed, whereupon the temperature of the yellowish suspension rises to room temperature. The suspension is then heated with an oil bath to 40° C. in the course of 2 hours and to 60° C. in the course of a further 2 hours. The batch is then stirred for 1 hour at 60° C. The resultant product is a yellow, readily pourable gel. The analogous compounds of the formulae (6a), (6b), (6c) and (6d) (see the Examples) are also obtained by the above procedure.

The adducts of the formula (5) are known and can be obtained in known manner by addition of 2 to 30 moles of ethylene oxide or propylene oxide to an aliphatic amine containing a hydrocarbon radical of 8 to 22 carbon atoms.

The process of the invention is conveniently carried out by adding e.g. to the respective coating liquor, which is prepared in conventional manner, the fluorescent whitening agent, an acid phosphoric acid ester of an oxyalkylated fatty amine of the formula (1) and, if desired, one or more of the additional assistants referred to above, singly and in any order, and dispersing them therein, for example in the temperature range from 10° to 150° C. Alternatively, the fluorescent whitening agent can also be mixed, before the addition to the coating liquor, with an acid phosphoric acid ester of an oxyalkylated fatty amine of the formula (1) and, if desired, with one or more of the additional assistants referred to above, advantageously with the addition of water, and the preparation so obtained can then be added, as described above, to the coating liquor. Paper or cardboard can then be coated with the ready-for-use coating composition, for example with an air-knife, a coating knife, a brush, a roller or doctor knife, a bar or another coating means customarily employed in the paper industry.

The amount of compound of the formula (1) employed in the process of this invention can vary within wide limits. Positive effects are observed even at a low ratio of fluorescent whitening agent to compound of the formula (1) of 1:0.5. This ratio is preferably 1:1, most preferably 1:1 to 1:3. Especially good effects are obtained using a ratio of 1:2. It would be entirely possible to use more compound of the formula (1) than corresponds to the ratio 1:5; however, this is not desirable both for economic reasons and on account of the effect on the consistency of the coating composition in actual practice. The amount of optional assistants (surfactants, solubilisers, polar compounds) can vary within wide limits. The ratio of fluorescent whitening agent to these assistants can be from 1:0.1 to 1:10, depending on the nature of the assistant employed (see also the Examples).

The amount of fluorescent whitening agent added to the coating composition fluctuates within the limits customary in the paper industry. Suitable amounts are e.g. from 1 to 50 g/l of coating composition, preferably from 4 to 20 g/l. As already mentioned, the invention also allows the use of higher concentrations of fluorescent whitening agent than normally employed (e.g. 4 to 8 g/l). Without the addition of compounds of the formula (1), a diminution in the degree of whiteness frequently occurs at concentrations of more than 10 g/l of fluorescent whitening agent, i.e. the coating composition takes on a greenish hue. But the addition of compounds of the formula (1) to the coating composition eliminates this effect and the degree of whiteness also increases with increasing concentration of fluorescent whitening agent.

The process of the invention is suitable for whitening coating compositions normally employed in the paper industry, viz. unpigmented, but especially pigmented, coating compositions. These coating compositions contain a polymer binder, an inorganic pigment (in the case of pigmented compositions) and, if desired, further ingredients, e.g. waxes, dispersants, wetting agents or other surface-active compounds, viscosity regulators, antifoams, lubricants, plasticisers and/or preservatives.

Suitable polymer binders are the polymer adhesive-binder systems commonly employed in the paper industry. For example, it is possible to use any of the known modified or converted starches such as oxidised, hydrolysed or hydroxyethylated starches. In addition to the different varieties and types of starch, it is possible to use other natural or synthetic polymer binder systems by themselves or, especially in the case of synthetic polymer binder systems, in combination with one another. Dispersions based on copolymers of butadiene/styrene, acrylonitrile/butadiene/styrene, acrylates, ethylene/vinyl chloride and ethylene/vinyl acetate, or based on homopolymers such as polyvinyl chloride, polyvinylidene chloride, polyethylene, polyvinyl pyrrolidone, polyvinyl alcohol and polyvinyl acetate, as well as polyurethanes, are suitable binders for the coating compositions to be whitened in the process of this invention. Degraded starches, alginates, carboxymethyl cellulose, proteins (e.g. gelatin, casein, soya protein) can also be used as binders.

As white pigments it is possible to use e.g. aluminium-magnesium silicates (China clay), calcium carbonate, $CaSO_4.1OH_2O$ (satin white), aluminium silicates and aluminium hydroxides, barium sulfate (barite), or titanium dioxide or mixtures of such pigments. In addition, sequestering agents can be added to the coating compositions to eliminate undesired traces of metal [e.g. Fe(III)], for example water-soluble poly- or metaphosphates and polycarboxylic acid salts.

To obtain good flow properties, an alkaline coating liquor is used for pigment coating. The alkaline reaction is conveniently effected with ammonia or NaOH or KOH or with sodium or potassium carbonates or borates or mixtures thereof.

Examples of suitable wetting agents are adducts of unsulfated or sulfated higher alkanol or alkylphenol polyglycol ethers containing 8 to 14 carbon atoms in the alkyl moiety with 1 to 20 moles of ethylene oxide.

Recipes for such known coating compositions to be whitened by the process of the invention are described e.g. in J. P. Casey, "Pulp and Paper"; Chemistry and Chemical Technology, 2nd Edition, Vol. III, pp. 1648–1649, and in McGraw-Hill, "Pulp and Paper Manufacture", 2nd Edition, Vol. II, p. 497.

The present invention also relates to the coating compositions whitened by the process of the invention, i.e. compositions containing a fluorescent whitening agent of the bis-triazinylaminostilbene-2,2'-disulfonic acid series, preferably a compound of the formula (3), especially one of the formula (4), and an acid phosphoric acid ester of an oxyalkylated fatty amine of the formula (1), preferably one of the formula (2).

Further, in addition to containing the fluorescent whitening agent and the acid phosphoric acid ester of an oxyalkylated fatty amine, the coating compositions of this invention can also contain non-ionic or anionic surfactants, organic solubilisers and/or polar organic compounds, e.g. as organic solubilisers, hydrophilic organic solvents, for example lower monohydric alcohols, polyhydric alcohols, ether alcohols, glycols, polyglycols, glycol ethers and polyglycol ethers, amides and/or amines or, as polar organic compounds, dimethyl sulfoxide, dimethyl sulfone, ethylene carbonate or propylene carbonate and/or urea, or non-ionic surfactants such as adducts of alkylene oxides with higher fatty acids, fatty acid amides, aliphatic alcohols, mercaptans or amines, with alkylphenols, alkylthiophenols or phenylphenols, copolymers of ethylene oxides and higher alkylene oxides, non-ionic esters of adducts of alkylene oxides, esters of polyalcohols, N-acylated alkanolamines and the adducts thereof with ethylene oxide and reaction products of higher fatty acids with an alkanolamine and/or, as surfactants, alkylene oxide adducts containing sulfate or other acid radicals, sulfates of N-acylated alkanolamines and sulfated esterified polyoxy compounds.

Finally, the present invention also relates to paper and cardboard coated with the coating compositions (as described above) of this invention.

The invention is described by the following Examples, in which parts and percentages are by weight, unless otherwise indicated.

EXAMPLES 1

(a) With stirring, 100 g of starch ("Paperol R 10") and 950 ml of demineralised water are heated in a 2 liter glass beaker to 80° C. in the course of 10 to 15 minutes, and then stirred for 15 minutes at 80°–85° C. A slightly turbid, grey, colloidal solution is obtained. The mixture is then cooled to about 40° C. and 50 ml of 4-nonylphenol oxyethylated with 9.7 moles of ethylene oxide (solution 1:25) are added. After it has been bulked with demineralised water of 40° C. to 1000 ml, the mixture is briefly shaken and the pH is adjusted to 8-9 with concentrated ammonia.

(b) To 15 ml of the starch liquor obtained in (a) are added 5 ml of a solution which consists of 11.6 g of the fluorescent whitening agent of the formula

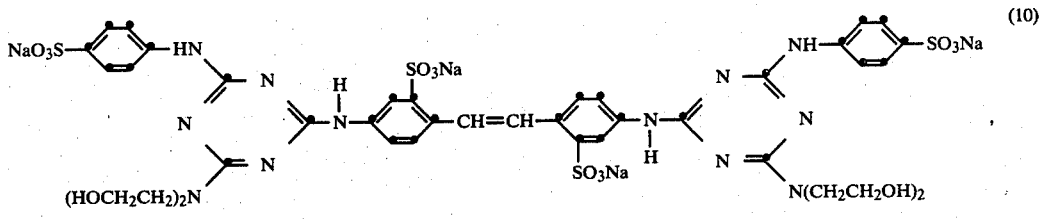

(10)

20 g of the acid phosphoric acid ester of an oxyalkylated fatty amine of the formula (6), 10 g of a 4-nonylphenol oxyethylated with 9.7 moles of ethylene oxide, 15 g of ethylene glycol, 18 g of polyethylene glycol 300, and 25.4 g of water. The resultant mixture is homogenised with a magnetic stirrer.

(c) After about 20 minutes the coating composition obtained in (b) is stirred again and prepared strips of coating paper are coated therewith in conventional manner. The degree of whiteness obtained on the paper so coated is distinctly higher than that obtained on a comparison strip of paper which is coated with a coating composition which does not contain the compound of the formula (6).

EXAMPLE 2

(a) With stirring, 100 g of starch ("Paperol R 10") and 950 ml of demineralised water are heated in a 2 liter glass beaker to 80° C. in the course of 10 to 15 minutes, and then stirred for 15 minutes at 80°–85° C. A slightly turbid, grey, colloidal solution is obtained to which are added 7.5 g of the acid phosphoric acid ester of an oxyalkylated fatty amine of the formula (6). The mixture is then cooled to about 40° C. and 50 ml of 4-nonylphenol oxyethylated with 9.7 moles of ethylene oxide (solution 1:25) are added. After it has been bulked with demineralised water of 40° C. to 1000 ml, the mixture is briefly shaken and the pH is adjusted to 8–9 with concentrated ammonia.

(b) To 15 ml of the starch liquor obtained in (a) are added 5 ml of a solution of 11.6 g of the fluorescent whitening agent of the formula (10) in 88.4 g of water. The resultant mixture is homogenised with a magnetic stirrer.

(c) After about 20 minutes the coating composition obtained in (b) is stirred again and prepared strips of coating paper are coated therewith in conventional manner. The degree of whiteness obtained on the paper so coated is distinctly higher than that obtained on a comparison strip of paper which is coated with a coating composition which does not contain the compound of the formula (6).

EXAMPLE 3

The procedure of Example 1 is repeated using, instead of the fluorescent whitening agent of the formula (10), the corresponding amount of a fluorescent whitening agent of each the following formulae:

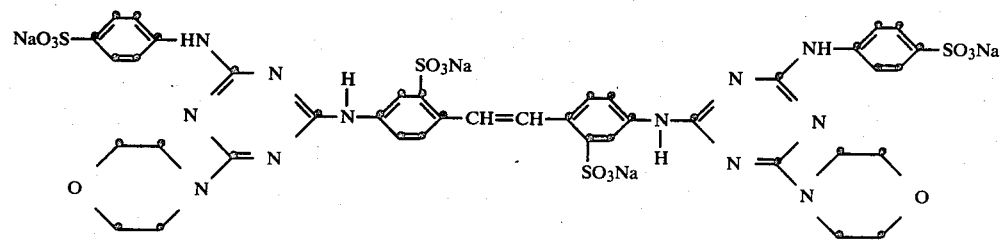

(11)

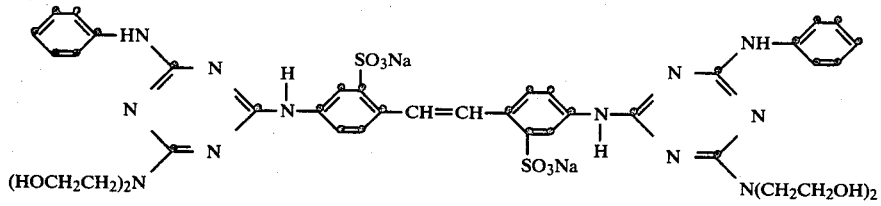

(12)

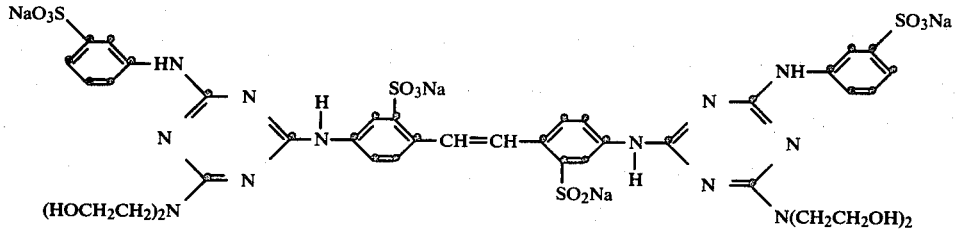

(13)

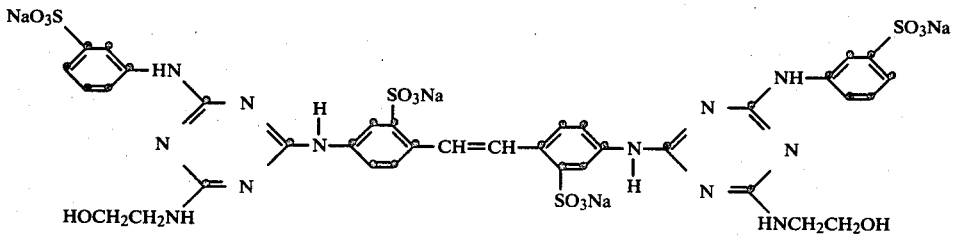

(14) oder

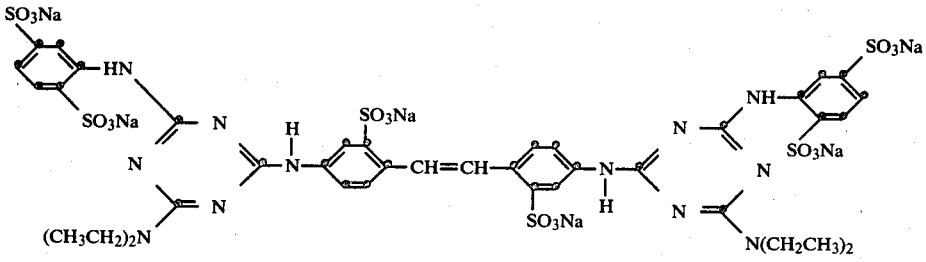

(15)

Paper having a similarly high degree of whiteness is obtained.

EXAMPLE 4

The procedure of Example 2 is repeated using, instead of the fluorescent whitening agent of the formula (10), the corresponding amount of a fluorescent whitening agent of the formulae (11), (12), (13), (14) or (15). Paper having a similarly high degree of whiteness is obtained.

EXAMPLE 5

To 15 ml of a starch liquor obtained in accordance with Example 1(a) are added 5 ml of each of the following solutions:

(A)

20 g of the compound of formula (6),
11.6 g of the fluorescent whitening agent of the formula (10),
15 g of ethylene glycol,
53.4 g of water;

(B)

10 g of the compound of formula (6),
5.8 g of the fluorescent whitening agent of the formula (10),
9 g of polyethylene glycol 300,
25.2 g of water;

(C)

10 g of the compound of formula (6),
5.8 g of the fluorescent whitening agent of the formula (10),
5 g of a 4-nonylphenol oxyethylated with 9.7 moles of ethylene oxide,
29.2 g of water;

(D)

10 g of the compound of formula (6),
5.8 g of the fluorescent whitening agent of the formula (10),
5 g of a 4-nonylphenol oxyethylated with 9.7 moles of ethylene oxide,
21.7 g of water;

(E)

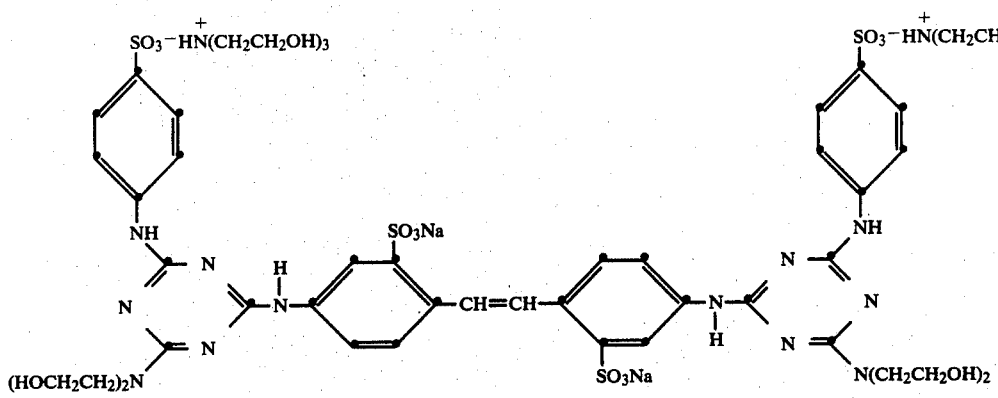

10 g of the compound of formula (6),
5.8 g of the fluorescent whitening agent of the formula (10),
7.5 g of ethylene glycol,
9 g of polyethylene glycol 300,
17.7 g of water.

The preparation of the respective coating composition and the coating of the paper are as described in Example 1(b) and 1(c). In each case, the paper has a degree of whiteness distinctly higher than that obtained on paper coated with a coating composition containing the individual formulations (A) to (E), but without the compound of formula (6).

EXAMPLE 6

To 15 ml of a starch liquor obtained in accordance with Example 1(a) are added 5 ml of each of the following solutions:

(A)

30 g of the compound of formula (6),
16.7 g of the fluorescent whitening agent of the formula (10a)

53.3 g of water;

(B)

30 g of the compound of formula (6),
16.7 g of the fluorescent whitening agent of the formula (10a),
9 g of urea,
44.3 g of water;

(C)

30 g of the compound of formula (6),
16.9 g of the fluorescent whitening agent of the formula (10b)

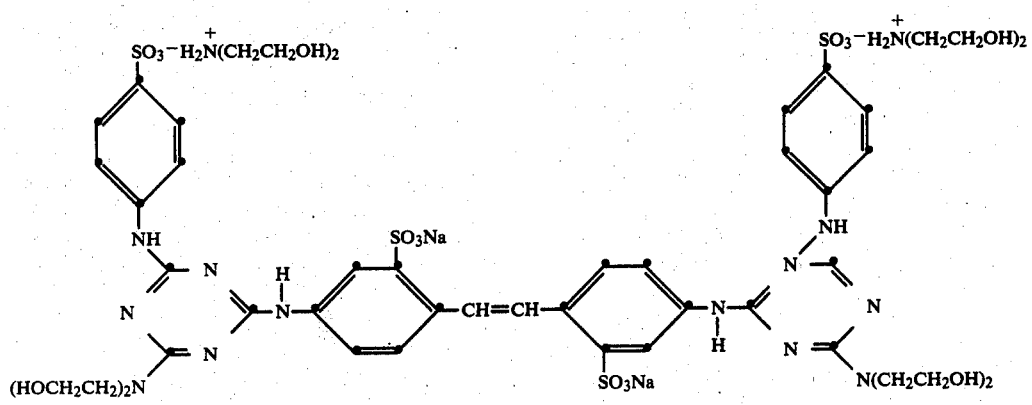

53.1 g of water;

(D)

30 g of the compound of the formula

Paper having a similarly high degree of whiteness is obtained by substituting a fluorescent whitening agent of the formula (11), (12), (13), (14) or (15) for that of the formula (10).

The individual components of solutions (A) to (E) can also be added singly and in any order to the coating composition, in which case similar results are obtained.

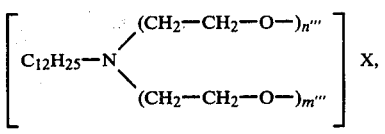

(6a)

wherein the sum of $n'''+m'''$ is 12 and X is as defined for formula (6), 16.9 g of the fluorescent whitening agent of the formula (10b), 53.1 g of water;

(E)

30 g of the compound of the formula

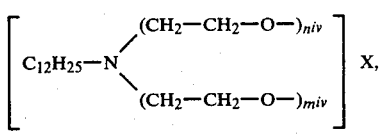

(6b)

wherein the sum of $n^{iv}+m^{iv}$ is 20 and X is as defined for formula (6), 16.9 g of the fluorescent whitening agent of the formula (10b), 53.1 g of water;

(F)

30 g of the compound of the formula

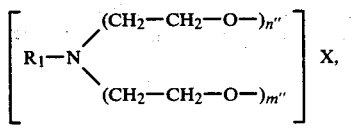

(6c)

wherein the sum of $n''+m''$ is 8, X is as defined for formula (6) and $R_1$ is the hydrocarbon radical of tallow fatty amine, 16.9 g of the fluorescent whitening agent of the formula (10b), 53.1 g of water.

The preparation of the coating composition and the coating of the paper are as described in Example 1(b) and 1(c). In each case, the paper has a degree of whiteness distinctly higher than that obtained on paper coated with a coating composition containing the individual formulations (A) to (F), but without the compound of the formula (6), (6a), (6b) or (6c).

Paper having a similarly high degree of whiteness is obtained by substituting corresponding amounts of a fluorescent whitening agent of the formula (11), (12), (13), (14) or (15) for that of the formula (10a) or (10b) in the solutions (A) to (F).

The individual components of solutions (A) to (F) can also be added singly and in any order to the coating compositions, in which case similar results are obtained.

EXAMPLE 7

(A) To 15 ml of a starch liquor obtained in accordance with Example 1(a) are added 1.1 g of the fluorescent whitening agent of the formula (15), 0.85 g of the acid ester of the formula (6) and 3 g of water. The resultant mixture is homogenised with a magnetic stirrer.

(B) To 15 ml of a starch liquor obtained in accordance with Example 1(a) are added 1.1 g of the fluorescent whitening agent of the formula (15), 0.51 g of the acid ester of the formula (6c), and 3.4 g of water. The resultant mixture is homogenised with a magnetic stirrer.

(C) Procedure (B) is repeated, substituting the same amount of an ester of the formula (6a) for the acid ester of the formula (6c).

(D) Procedure (B) is repeated, substituting the same amount of an ester of the formula (6b) for the acid ester of formula (6c).

After about 20 minutes the coating compositions (A) to (D) are stirred once more and prepared strips of coating paper are coated therewith in conventional manner. The degree of whiteness obtained on the paper strips is in each case distinctly higher than that obtained on comparison strips coated with compositions which do not contain the acid ester of the formula (6), (6a), (6b) or (6c).

EXAMPLE 8

(a) With stirring, 150 ml of an aqueous dispersion of a copolymer of acrylate and styrene (free from plasticisers and solvent), 100 ml of the sodium salt of a polycarboxylic acid (solution 1:50), 500 ml of China clay Dinkie A, and 50 ml of a 4-nonylphenol oxyethylated with 9.7 moles of ethylene oxide (solution 1:25) are added to 600 ml of water. The mixture is stirred until a homogeneous coating liquor is obtained. This pigmented coating liquor is deaerated and freed from coarser impurities by sieving it through a nickel sieve.

(b) To 15 ml of the pigmented coating liquor obtained in (a) are added 5 ml of a solution consisting of 11.6 g of the fluorescent whitening agent of the formula (10), 20 g of the acid phosphoric acid ester of an oxyalkylated fatty amine of the formula (6), 10 g of a 4-nonylphenol oxyethylated with 9.7 moles of ethylene oxide, 15 g of ethylene glycol, 18 g of polyethylene glycol 300, and 25.4 g of water. The resultant mixture is homogenised with a magnetic stirrer.

(c) After about 20 minutes, the coating composition obtained in (b) is stirred once more and prepared strips of coating paper are coated therewith in conventional manner. The degree of whiteness obtained on the paper so coated is distinctly higher than that obtained on comparison paper which is coated with a coating composition that does not contain the compound of formula (6).

EXAMPLE 9

(a) With stirring, 14 g of the compound of formula (6), 150 ml of an aqueous dispersion of a copolymer of acrylate and styrene (free from plasticisers and solvent), 100 g of the sodium salt of a polycarboxylic acid (solution, 1:50), 500 ml of China clay Dinkie A, and 50 ml of a 4-nonylphenol oxyethylated with 9.7 moles of ethylene oxide (solution 1:25), are added to 600 ml of water. The mixture is stirred until homogeneous. This pigmented coating liquor is then deaerated and freed from coarser impurities by sieving it through a nickel sieve.

(b) To 15 ml of the pigmented coating liquor obtained in (a) are added 5 ml of a solution consisting of 11.6 g of the fluorescent whitening agent of the formula (10) in 88.4 g of water. The resultant mixture is homogenised with a magnetic stirrer.

(c) After about 20 minutes, the coating composition obtained in (b) is stirred once more and prepared strips of coating paper are coated therewith in conventional manner. The degree of whiteness obtained on the paper so coated is distinctly higher than that obtained on comparison paper which is coated with a coating composition that does not contain the compound of formula (6).

EXAMPLE 10

The procedure of Example 8 is repeated, substituting the corresponding amount of a fluorescent whitening agent of the formula (11), (12), (13), (14) or (15) for that of the formula (10). Paper having a similarly high degree of whiteness is obtained.

EXAMPLE 11

The procedure of Example 9 is repeated, substituting the corresponding amount of a fluorescent whitening agent of the formula (11), (12), (13), (14) or (15) for that of the formula (10). Paper having a similarly high degree of whiteness is obtained.

EXAMPLE 12

To 15 ml of a pigmented coating liquor obtained in accordance with Example 8(a) are added 5 ml of each of the solutions (A) to (E) as defined in Example 5. The preparation of the coating composition and the coating of the paper are carried out as described in Example 8(b). In each case the paper so coated has a degree of whiteness which is distinctly higher than that obtained with the formulations (A) to (E) without the compound of formula (6). Paper having a similarly high degree of whiteness is obtained by substituting the corresponding amount of a fluorescent whitening agent of the formula (11), (12), (13), (14) or (15) for that of the formula (10) in the solutions (A) to (E).

EXAMPLE 13

(a) 600 ml of demineralised water, 10 ml of concentrated ammonia, and 35 g of casein are put into a 2 liter glass beaker and heated, with stirring, to 70° C. for 10 minutes. Stirring is then continued for 15 minutes at 70°–75° C. A turbid, sand-coloured colloidal solution is obtained. The casein solution, which is cooled to 30° C., is added to a mixture of 50 ml of the sodium salt of a polycarboxylic acid (aqueous solution 1:50) and 400 g of China clay SPS. This mixture is slowly stirred for 3 minutes. Stirring is then discontinued and any pigment adhering to the sides is scraped off. The mixture is then slowly stirred once more for 2 minutes. Then 3 ml of concentrated ammonia and 80 ml of styrene-butadiene latex are stirred in and the batch is slowly stirred for a further 3 minutes. Finally, 50 ml of a 4-nonylphenol oxyethylated with 9.7 moles of ethylene oxide (aqueous solution 1:25) are added and stirring is continued for about 15 seconds. The so prepared liquor is deaerated and freed from coarser impurities by sieving it through a nickel sieve, then put into a 1 liter conical flask and bulked with demineralised water to a weight of 1260 g/l.

(b) To 15 ml of the coating liquor obtained in (a) are added 5 ml of a solution consisting of 11.6 g of the fluorescent whitening agent of the formula (10), 20 g of the acid phosphoric acid ester of an oxyalkylated fatty amine of the formula (6), 10 g of a 4-nonylphenol oxyethylated with 9.7 moles of ethylene oxide, 15 g of ethylene glycol, 18 g of polyethylene glycol 300, and 25.4 g of water. The mixture is homogenised with a magnetic stirrer.

(c) After about 20 minutes, the coating composition obtained in (b) is stirred once more and prepared strips of coating paper are coated therewith in conventional manner. The degree of whiteness obtained on the paper so coated is distinctly higher than that obtained on comparison paper which is coated with a coating composition that does not contain the compound of formula (6).

EXAMPLE 14

The procedure of Example 13(a) is repeated, except that 14 g of the compound of the formula (6) are added to the coating composition prepared according to Example 13(a). To 15 ml of this coating composition are added 5 ml of a solution consisting of 11.6 g of the fluorescent whitening agent of the formula (10) and 88.4 g of water. The mixture is homogenised with a magnetic stirrer. Further processing is as described in Example 13(c). The coated paper has a degree of whiteness which is distinctly higher than that obtained by coating the paper with a composition which does not contain the compound of formula (6).

Instead of the fluorescent whitening agent of formula (10), it is possible to use the fluorescent whitening agents of the formulae (11), (12), (13), (14) and (15) with equal success in Examples 13 and 14.

By substituting an ester of the formula (6a), (6b) or (6c) for the acid ester of the formula (6) in Examples 8 to 14 there is obtained, in each case, whitened paper which has a higher degree of whiteness than paper which is coated with a composition that does not contain such an acid ester.

What is claimed is:

1. A process for obtaining a coating composition of improved whiteness, for coating paper or cardboard, comprising the step of adding to the coating composition, which includes an effective amount of a paper coating binder, a fluorescent whitening agent of the bis-triazinylaminostilbene-2,2-disulfonic acid series and an acid phosphoric acid ester of an oxyalkylated fatty amine of the formula

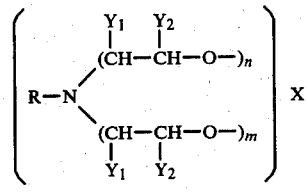

or an alkali metal salt, ammonium salt or amine salt thereof, wherein R is an aliphatic hydrocarbon radical of 8 to 22 carbon atoms, $Y_1$ and $Y_2$ are both hydrogen, or one of $Y_1$ and $Y_2$ is hydrogen and the other is methyl, X is the acid radical of phosphoric acid, the acid hydrogen atoms of which radical can be replaced by alkali metal ions, ammonium ions or amine salt ions, and m and n are integers, the sum of which is 2 to 30.

2. A process according to claim 1, which comprises the use of an acid phosphoric acid ester of an oxyalkylated fatty amine of the formula

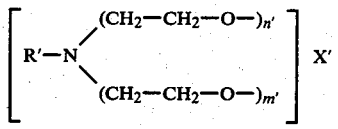

wherein R′ is an alkyl or alkenyl radical of 10 to 18 carbon atoms, X′ is the acid radical of phosphoric acid, the acid hydrogen atoms of which radical can also be replaced by alkali metal ions or ammonium ions, and n′ and m′ are integers, the sum of which is 4 to 20.

3. A process according to claim 2, which comprises the use of an acid phosphoric acid ester of an oxyalkylated fatty amine in which R′ is the lauryl radical, the sum of n′+m′ is 6 to 8, and the phosphoric acid radical is not in salt form.

4. A process according to claim 1, which comprises the use of a fluorescent whitening agent of the formula

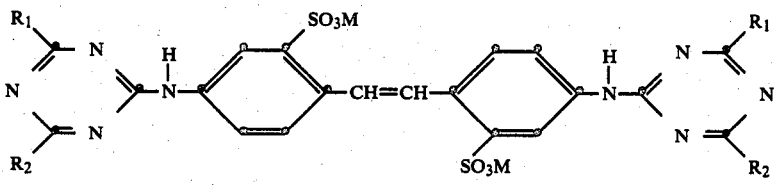

wherein $R_1$ and $R_2$ are $NH_2$, $NH—CH_3$, $NH—C_2H_5$, $N(CH_3)_2$, $N(C_2H_5)_2$, $NH—CH_2—CH_2—OH$, $NH—CH_2—CH_2—CH_2—OH$, $N(CH_2—CH_2—OH)_2$, $N(CH_2—CH_2—CH_2OH)_2$, $N(CH_3)(CH_2—CH_2—OH)$, $NH—CH_2—CH_2—O—CH_2—CH_2—OH$, $NH—CH_2—CH_2—SO_3M$, OH, $OCH_3$, $OCH(CH_3)_2$, $O—CH_2—CH_2—O—CH_3$,

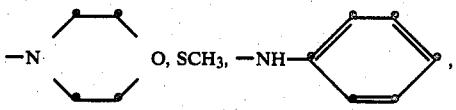

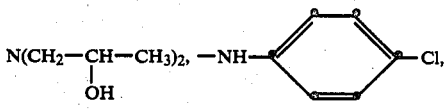

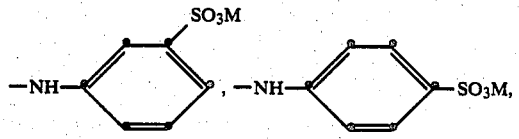

-continued

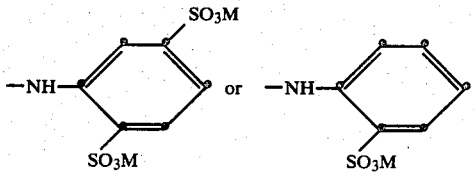

and M is hydrogen, an alkali metal ion, an ammonium ion or an amine salt ion.

5. A process according to claim 4, which comprises the use of a fluorescent whitening agent of the formula

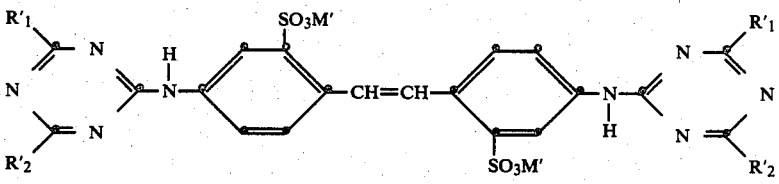

wherein $R_1'$ is $—NHCH_2CH_2OH$, $—N(CH_2CH_2OH)_2$, $—N(CH_2CH_3)_2$ or

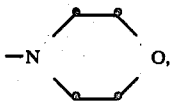

$R_2'$ is

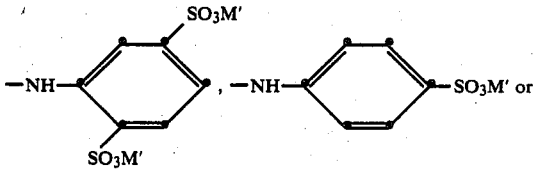

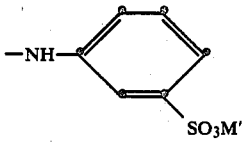

and M′ is hydrogen or an alkali metal ion, an ammonium, diethanolammonium or triethanoammonium ion.

6. A process according to claim 1, which comprises adding to the coating composition, besides fluorescent whitening agent and acid phosphoric acid ester of an oxyalkylated fatty amine, also a non-ionic or anionic surfactant, an organic solubiliser or a polar organic compound, or mixtures thereof.

7. A process according to claim 6, which comprises adding to the coating composition, as solubiliser, a hydrophilic organic solvent such as a lower monohydric alcohol, a polyhydric alcohol, an ether alchol, a glycol, polyglycol, glycol ether or polyglycol ether, an amide or amine, or, as polar organic compound, dimethyl sulfoxide, dimethyl methanephosphonate, dimethyl sulfone, sulfolane, ethylene carbonate or propylene carbonate, urea or a substituted urea, or a mixture of such compounds.

8. A process according to claim 6, which comprises adding to the coating composition, as non-ionic surfactant, an adduct of an alkylene oxide with a higher fatty acid, fatty acid amide, aliphatic alcohol, mercaptan or amine, with an alkylphenol, alkylthiophenol or phenylphenol, a copolymer of ethylene oxide and a higher alkylene oxide, a non-ionic ester of an adduct of an alkylene oxide, an ester of a polyalcohol, a N-acylated alkanolamine or an adduct thereof with ethylene oxide, and a reaction product of a higher fatty acid with an alkanolamine, or, as anionic surfactant, an alkylene oxide adduct containing sulfate or other acid radicals, a sulfate of a N-acylated alkanolamine, or a sulfated esterified polyoxy compound, or a mixture of said surfactants.

9. A process according to claim 1, wherein the fluoroescent whitening agent is mixed with the acid phosphoric acid ester of an oxyalkylated fatty amine and, if desired, with optional assistants as defined in claims 6 to 8 and, optionally, water, and this mixture is mixed with the coating composition.

10. A process according to claim 1, which comprises adding to the coating composition, independently of one another and separately, the fluorescent whitening agent and the acid phosphoric acid ester of an oxyalkylated fatty amine.

11. A process according to claim 10, comprising additionally adding to the coating composition a non-ionic or anionic surfactant, an organic solubilizer or a polar organic compound, or mixtures thereof.

12. A coating composition for coating paper and cardboard, said composition containing a fluorescent whitening agent of the bis-triazinylaminostilbene-2,2'disulfonic acid series, an effective amount of a paper-coating binder, and an acid phosphoric acid ester of an oxyalkylated fatty amine of the formula.

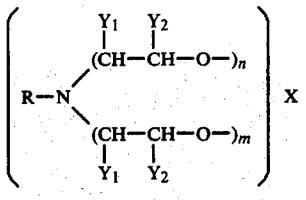

or an alkali metal salt, ammonium salt or amine salt thereof, wherein R is an aliphatic hydrocarbon radical of 8 to 22 carbon atoms, $Y_1$ and $Y_2$ are both hydrogen, or one of $Y_1$ and $Y_2$ is hydrogen and the other is methyl, X is the acid radical of phosphoric acid, the acid hydrogen atoms of which radical can be replaced by alkali metal ions, ammonium ions or amine salt ions, and m and n are integers, the sum of which is 2 to 30.

13. A coating composition according to claim 12 which, in addition to containing the fluorescent whitening agent and the acid phosphoric acid ester of an oxyalkylated fatty amine, contains a non-ionic or anionic surfactant, an organic solubiliser or a polar organic compound, or mixtures thereof.

14. A coating composition according to claim 13 which contains, as organic solubiliser, a hydrophilic organic solvent such as a lower monohydric alcohol, a polyhydric alcohol, an ether alcohol, a glycol, polyglycol, glycol ether or polyglycol ether, an amide or amine, or, as polar organic compound, dimethyl sulfoxide, dimethyl methanephosphonate, dimethyl sulfone, sulfolane, ethylene carbonate or propylene carbonate, urea or a substituted urea, or a mixture of such compounds.

15. A coating composition according to claim 13 which contains, an non-ionic surfactant, an adduct of an alkylene oxide with a higher fatty acid, fatty acid amide, aliphatic alcohol, mercaptan or amine, with an alkylphenol, alkylthiophenol or phenylphenol, a copolymer of ethylene oxide and a higher alkylene oxide, a non-ionic ester of an adduct of an alkylene oxide, an ester of a polyalcohol, a N-acylated alkanolamine or an adduct thereof with ethylene oxide, and a reaction product of a higher fatty acid with an alkanolamine, or, as anionic surfactant, an alkylene oxide adduct containing sulfate or other acid radicals, a sulfate of a N-acylated alkanolamine, or a sulfated esterified polyoxy compound, or a mixture of said compounds.

16. Paper or cardboard coated with a coating composition as defined in claim 12 or 13.

* * * * *